US007541893B2

(12) United States Patent
Ye

(10) Patent No.: US 7,541,893 B2
(45) Date of Patent: Jun. 2, 2009

(54) CERAMIC RF FILTER AND DUPLEXER HAVING IMPROVED THIRD HARMONIC RESPONSE

(75) Inventor: Tao Ye, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 209 days.

(21) Appl. No.: 11/398,365

(22) Filed: Apr. 4, 2006

(65) Prior Publication Data

US 2006/0261913 A1 Nov. 23, 2006

Related U.S. Application Data

(60) Provisional application No. 60/683,986, filed on May 23, 2005.

(51) Int. Cl.
*H01P 1/213* (2006.01)
*H01P 1/205* (2006.01)

(52) U.S. Cl. ..... 333/134; 333/202; 333/206

(58) Field of Classification Search ..... 333/134, 333/202, 206
See application file for complete search history.

(56) References Cited

U.S. PATENT DOCUMENTS 4,742,562 A 5/1988 Kommrusch
4,823,098 A 4/1989 DeMuro et al.
4,855,693 A 8/1989 Matsukura et al.
4,896,124 A 1/1990 Schwent
5,057,803 A 10/1991 Ooi et al.
5,572,175 A 11/1996 Tada et al.
5,793,267 A 8/1998 Tada et al.
5,929,721 A 7/1999 Munn et al.
5,994,978 A * 11/1999 Vangala ..... 333/134
6,181,223 B1 1/2001 Ito
6,420,202 B1 7/2002 Barber et al.
6,420,942 B1 7/2002 Hiroshima et al.
6,650,202 B2 11/2003 Rogozine et al.
7,075,388 B2 7/2006 Rogozine et al.

FOREIGN PATENT DOCUMENTS

WO WO01/52344 7/2001
WO WO2004/107494 12/2004

* cited by examiner

*Primary Examiner*—Benny Lee
(74) *Attorney, Agent, or Firm*—Mark P. Bourgeois; Daniel J. Deneufbourg

(57) ABSTRACT

A duplexing filter suitable for use in a mobile communication system. The filter has a core of dielectric material with several through holes that define resonators. The core has metallized surfaces except for a portion of the top and bottom surfaces. At least one metallized resonator pad surrounds through holes on the top and bottom surfaces. A metallized serpentine region extends from the resonator pad on the bottom surface toward a side surface of the core. The metallized serpentine region causes attenuation of a third harmonic frequency.

14 Claims, 8 Drawing Sheets

CERAMIC RF FILTER AND DUPLEXER HAVING IMPROVED THIRD HARMONIC RESPONSE

CROSS-REFERENCE TO RELATED APPLICATION

This application claims the benefit of the filing date of U.S. Provisional Application Ser. No. 60/683,986, filed on May 23, 2005, which is explicitly incorporated herein by reference as are all references cited therein.

TECHNICAL FIELD

This invention relates to dielectric block filters for radio-frequency signals, and in particular, to monoblock single passband and duplexing filters.

BACKGROUND

Ceramic block filters offer several advantages over lumped component filters. The blocks are relatively easy to manufacture, rugged, and relatively compact. In the basic ceramic block filter design, the resonators are formed by typically cylindrical passages, called holes or poles, extending through the block from the long narrow side to the opposite long narrow side. The block is substantially plated with a conductive material (i.e. metallized) on all but one of its six (outer) sides and on the inside walls formed by the resonator holes.

One of the two opposing sides containing through-hole openings is not fully metallized, but instead bears a metallization pattern designed to couple input and output signals through the series of resonators. This patterned side is conventionally labeled the top of the block. In some designs, the pattern may extend to sides of the block, where input/output electrodes are formed.

The reactive coupling between adjacent resonators is dictated, at least to some extent, by the physical dimensions of each resonator, by the orientation of each resonator with respect to the other resonators, and by aspects of the top surface metallization pattern. Interactions of the electromagnetic fields within and around the block are complex and difficult to predict.

These filters may also be equipped with an external metallic shield attached to and positioned across the open-circuited end of the block in order to cancel parasitic coupling between non-adjacent resonators and to achieve acceptable stopbands.

Although such RF signal filters have received widespread commercial acceptance since the 1980s, efforts at improvement on this basic design continued.

In the interest of allowing wireless communication providers to provide additional service, governments worldwide have allocated new higher RF frequencies for commercial use. To better exploit these newly allocated frequencies, standard setting organizations have adopted bandwidth specifications with compressed transmit and receive bands as well as individual channels. These trends are pushing the limits of filter technology to provide sufficient frequency selectivity and band isolation.

Coupled with the higher frequencies and crowded channels are the consumer market trends towards ever smaller wireless communication devices (e.g. handsets) and longer battery life. Combined, these trends place difficult constraints on the design of wireless components such as filters. Filter designers may not simply add more space-taking resonators or allow greater insertion loss in order to provide improved signal rejection.

A specific challenge in RF filter design is providing sufficient attenuation (or suppression) of signals that are outside the target passband at frequencies which are integer multiples of the frequencies within the passband. The label applied to such integer-multiple frequencies of the passband is a "harmonic." Providing sufficient signal attenuation at the third ($3^{rd}$) harmonic has been a persistent challenge.

An example of an RF filter is shown in U.S. Pat. No. 6,650,202.

Therefore, it is desirable to provide an RF filter that better attenuates $3^{rd}$ harmonic frequencies without sacrificing other performance parameters such as size, passband insertion loss and material costs.

SUMMARY OF THE INVENTION

This invention overcomes problems of the prior art by providing a ceramic block RF filter having improved $3^{rd}$ harmonic rejection in a small size.

The filter includes a core of dielectric material that has a top, a bottom and four side surfaces having vertical edges. A plurality of through-holes extends from the top to the bottom surface. Each through-hole defines a resonator. A first contiguous unmetallized area is located on the top surface and extends to one of the side surfaces. A second contiguous unmetallized area is located on the bottom surface and extends to one of the side surfaces. A first metallized area is located on the bottom surface, the side surfaces and on the inner surfaces of the through-holes. A transmitter electrode and a receiver electrode are located on the top surface and extend to one of the side surfaces. An antenna electrode is located on the bottom surface and extends to one of the side surfaces. A first set of metallized resonator pads are adjacent a portion of the through-holes on the top surface. The first set of resonator pads is connected to the first metallized area. A second resonator pad is adjacent one of the through-holes on the bottom surface. The second resonator pad is connected to the first metallized area. A metallized serpentine region extends from the second resonator pad towards one of the side surfaces.

There are other advantages and features of this invention, which will be more readily apparent from the following detailed description of preferred embodiments of the invention, the drawings, and the appended claims.

Figure 1:
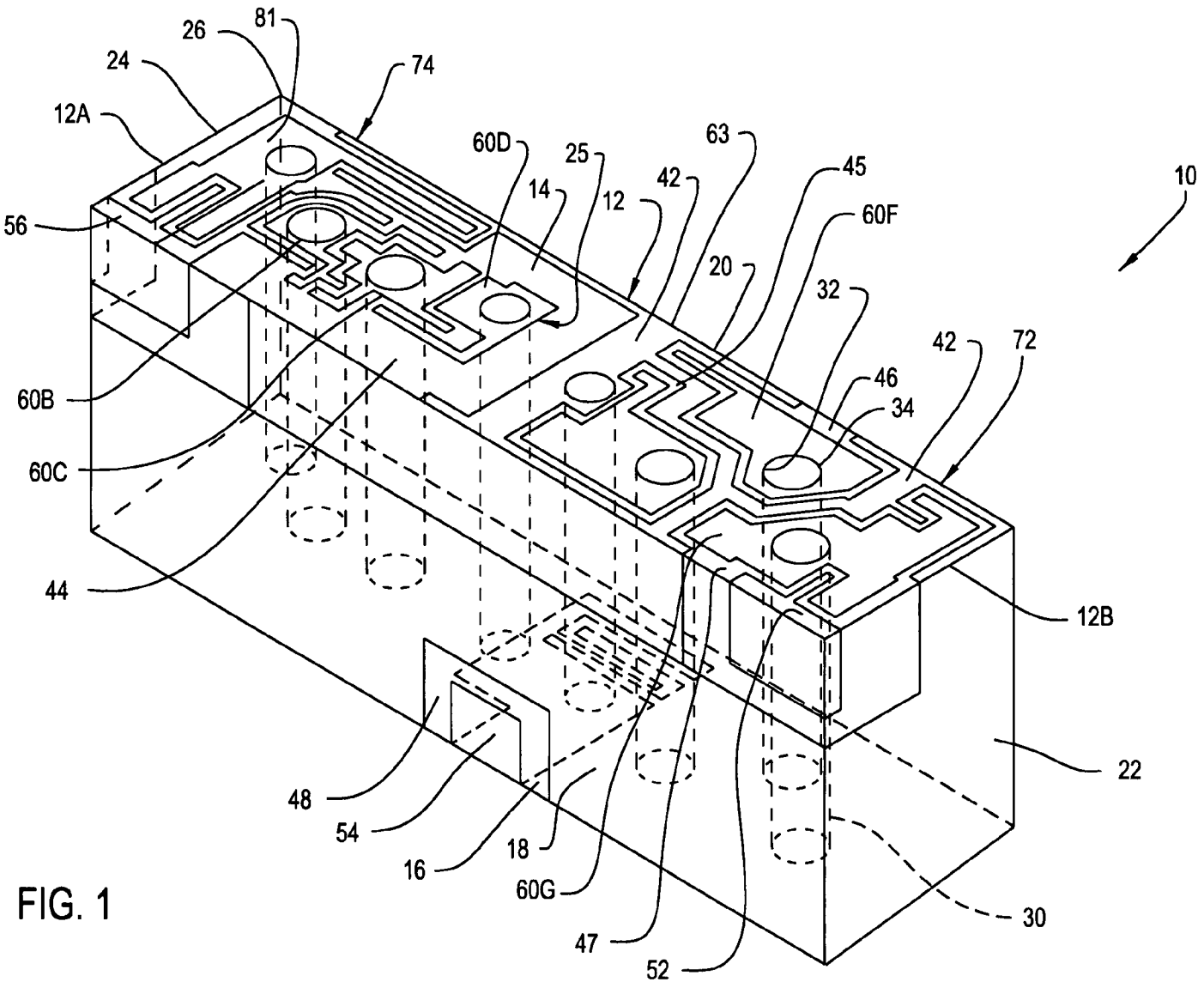
FIG. 1 is an enlarged perspective (or more precisely an isometric) view of a duplexing filter according to the present invention showing the details of the surface-layer pattern of metallized and unmetallized areas and showing the hidden features.

The figures are not drawn to scale.

DETAILED DESCRIPTION OF PREFERRED EMBODIMENT

While this invention is susceptible to embodiment in many different forms, this specification and the accompanying drawings disclose only preferred forms as examples of the invention. The invention is not intended to be limited to the embodiments so described, however. The scope of the invention is identified in the appended claims.

Referring to FIGS. 1-6, an antenna duplexer or RF filter 10 comprises an elongate, parallelepiped or box-shaped rigid core of ceramic dielectric material 12. The dielectric material is preferably barium or neodymium ceramic. Preferred dielectric materials for the rigid core 12 have a dielectric constant of about 37 or above. Core 12 has ends 12A and 12B (FIGS. 1-5). Core 12 has an outer surface with six sides, a top 14 (FIGS. 1, 2, 3, 5, 6), a bottom 16 (FIGS. 4. 5, 6), a first side 18 (FIGS. 1, 2, 3, 4, 6), an opposite second side 20 (FIGS. 1, 2, 3, 4, 6), third side 22 (FIGS. 1-5), and an opposite fourth side 24 (FIGS. 1-5). Multiple vertical edges 26 (FIGS. 1-3) are defined by adjacent sides of core 12.

The filter has a plurality of resonators 25 (FIGS. 1-3) defined by metallized through-holes. Specifically, the resonators take the form of through-holes 30 (FIGS. 1,3,4) defined in dielectric core 12 with metallized side walls. Through-holes 30 extend from openings 34 (FIGS. 1,3,4) in top surface 14 to openings 35 (FIG. 4) in bottom surface 16. The through-holes have an inner side wall surface 32 (FIGS. 1-4).

Core 12 has a surface-layer pattern 40 (FIGS. 2-5) of metallized and unmetallized areas or patterns. The metallized areas are preferably a surface layer of conductive silver-containing material. Pattern 40 includes a wide area or pattern of metallization 42 that covers a portion of bottom surface 16 and side surfaces 20, 22 and 24. Wide area of metallization 42 also covers a portion of top surface 14 and side surface 18 and side walls 32 of through holes 30. Metallized area 42 extends contiguously from within resonator holes 30 towards both top surface 14 and bottom surface 18. Metallization area 42 may also be labeled a ground electrode. Area 42 serves to absorb or prevent transmission of off-band signals.

In a preferred embodiment, the more detailed aspects of pattern 40 are present on top surface 14 and bottom surface 16. For example, a portion of metallized area 42 is present in the form of resonator pads 60A, 60B, 60C, 60D, 60E, 60F, 60G and 60H (FIGS. 2 and 4) which are adjacent to and surround each of the openings 34. Resonator pads 60A-60H are contiguous or connected with metallization area 42 that extends from inner surface 32 of through-holes 30. Resonator pads 60A-60H at least partially surround openings 34 of through-holes 30. Resonator pads 60A-60H are shaped to have predetermined capacitive couplings to adjacent resonators and other areas of surface-layer metallization.

Five unmetallized areas or patterns 44 (FIGS. 1,2,3,5,6), 45 (FIGS. 1-3), 46 (FIGS. 1-3), 47 (FIGS. 1,2,3,5) and 48 (FIGS. 1,2,4,5) extend over portions of top surface 14, bottom surface 16 and portions of side surfaces 18, 22 and 24. The unmetallized areas surround at least one of the metallized resonator pads 60A-60H. Referring to FIG. 3, unmetallized area 44 surrounds metallized resonator pads 60A, 60B, 60C and 60D. Unmetallized area 45 surrounds metallized resonator pad 60E. Unmetallized area 46 surrounds metallized resonator pad 60F. Unmetallized area 47 surrounds metallized resonator pad 60G. Unmetallized area 48 surrounds metallized resonator pad 60H (FIG. 4).

Resonator pad 60H on bottom surface 16 includes an intricate metallized extension 62 (FIG. 4) that extends from pad 60H, towards side surface 20. Intricate extension 62 preferably has a sinuous or serpentine shape and thus defines a plurality of elongate horizontal, spaced-apart and parallel continuous metallized strips 62A, 62B and 62C extending between the resonator through-hole opening 34 and the outer horizontal edge of side surface 20. Intricate extension 62 could also be labeled a metallized serpentine region. As shown in FIG. 4, resonator pad 60H surrounds the opening 34 of a centrally located resonator through-hole 30, i.e., the fourth through-hole when counting from the side surface 22 and extends from the opening 34 in the direction of and into coupling relationship with the metallized antenna connection area 54 which extends onto the side surface 18. Intricate extension or area 62 defines an integral extension of the pad 60H which extends between the through-hole opening 34 and the opposite side surface 20.

Metallized serpentine region 62 extends toward a horizontal portion 63 (FIG. 4) of metallization area 42, which is adjacent and parallel to side 20. Unmetallized area 48 extends around serpentine region 62 and forms horizontal, parallel and spaced-apart slots 64 (FIG. 4). Unmetallized area 48 also includes a horizontal gap 68 (FIG. 4) which separates metallized region or strip 62 from metallized portion 63. Area 48 still further defines a pair of unmetallized areas 102 and 104 (FIG. 4) extending along opposite sides of extensions 62 between the side surfaces 18 and 20 in a generally perpendicular relationship to the strips defining the extension 62.

Metallization area or pattern 42 on the top surface 14 (FIG. 3) also includes a connecting portion or strip 66 (FIG. 3) extending generally perpendicularly between the side surfaces 18,20 and surrounding one of the through-holes 30.

The surface pattern 40 includes metallized areas and unmetallized areas. The metallized areas are spaced apart from one another and are therefore capacitively coupled. The amount of capacitive coupling is roughly related to the size of the metallization areas and the separation distance between adjacent metallized portions as well as the overall core configuration and the dielectric constant of the core dielectric material. Similarly, surface pattern 40 also creates inductive coupling between the metallized areas. Metallized serpentine region 62 causes a series resonant circuit to be formed between the resonator pad 60H and the wide area of metallization 42.

The series resonant circuit includes a capacitance and an inductance in series connected to ground. The shape of the serpentine metallized region 62, the metallized strips 62A, 62B and 62C defining the same, the unmetallized slots 64 defined between the metallized strips of region 62, the gap 68, and metallized area 63 determine the overall capacitance and inductance values. The capacitance and inductance values are designed to form the series resonant circuit to be resonant at a third harmonic frequency that is desired to be filtered. The metallized serpentine region 62 causes attenuation of the third harmonic frequency. Serpentine region 62 can be added to or incorporated into additional areas of the resonator pads 60 to improve the attenuation.

Surface-layer pattern 40 additionally includes three isolated metallized areas for connection to transceiver components: a transmitter connection area or pattern or electrode 52 (FIGS. 1,2,3,5,), an antenna connection area or pattern or electrode 54 (FIGS. 1,2,4,5), and a receiver connection area or pattern or electrode 56 (FIGS. 1,2, 3,5,6). Connection areas 52, 54 and 56 are conventionally called electrodes. Electrodes 52 and 56 are located on top surface 14 and extend onto side surface 18 where they can serve as surface mounting connection points. Electrode 54 is located on bottom surface 16 and extends onto side surface 18 where it can serve as a surface mounting connection point. A portion of unmetallized area 44 extends from the top surface 14 into the side surface 18 where it surrounds at least a portion of connection area or electrode 56. Unmetallized area 47 includes an expanded region which extends from the top surface 14 into the side surfaces 18 and 22 and completely surrounds connection area or electrode 52. A portion of unmetallized area 48 extends from the bottom surface 16 and into the side surface 18 where it completely surrounds connection area or electrode 54.

Figure 2:
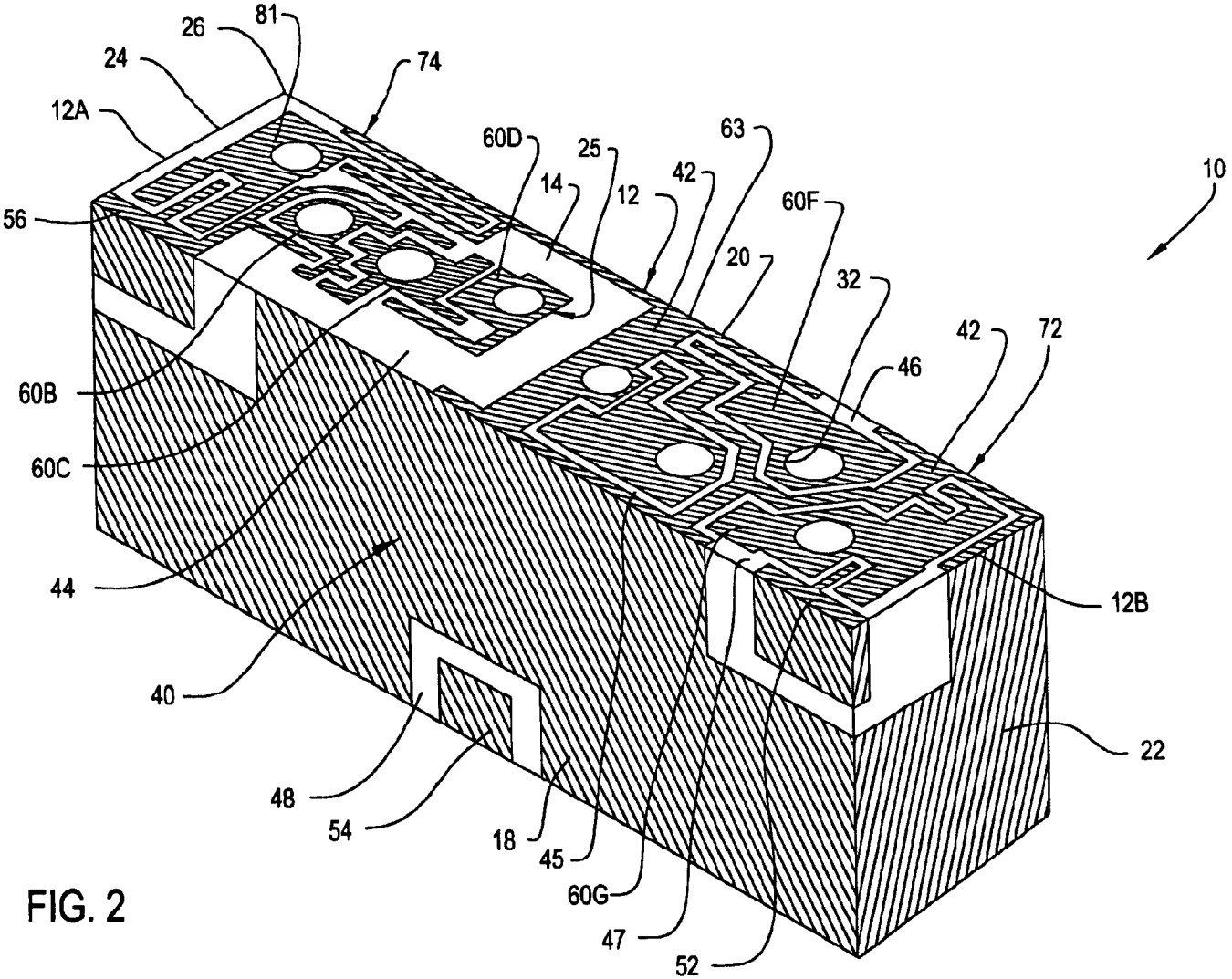
FIG. 2 is a perspective view of FIG. 1 showing the surface metallization patterns.
Figure 3:
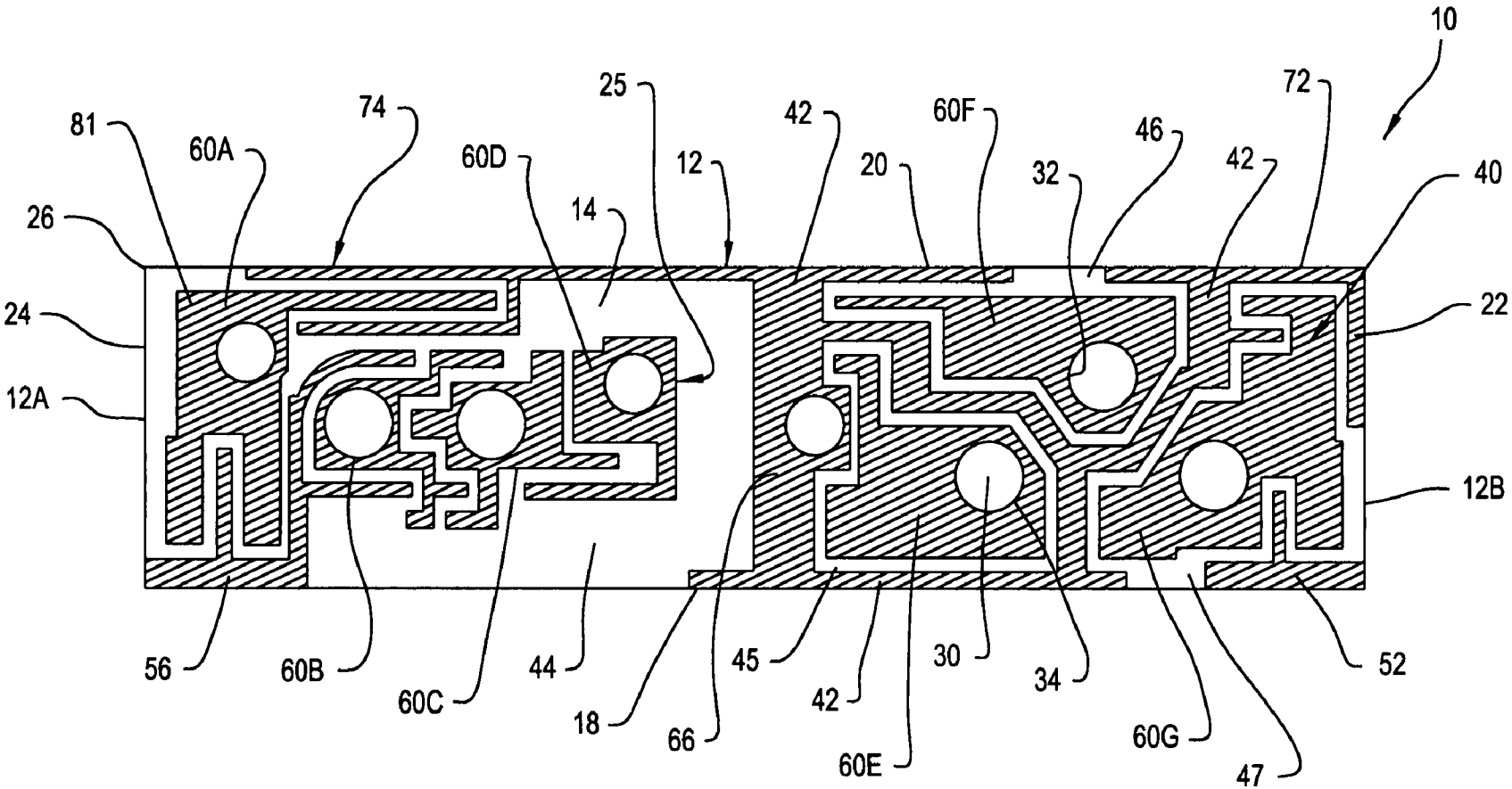
FIG. 3 is an enlarged view of the top surface of the duplexer of FIG. 1.
Figure 4:
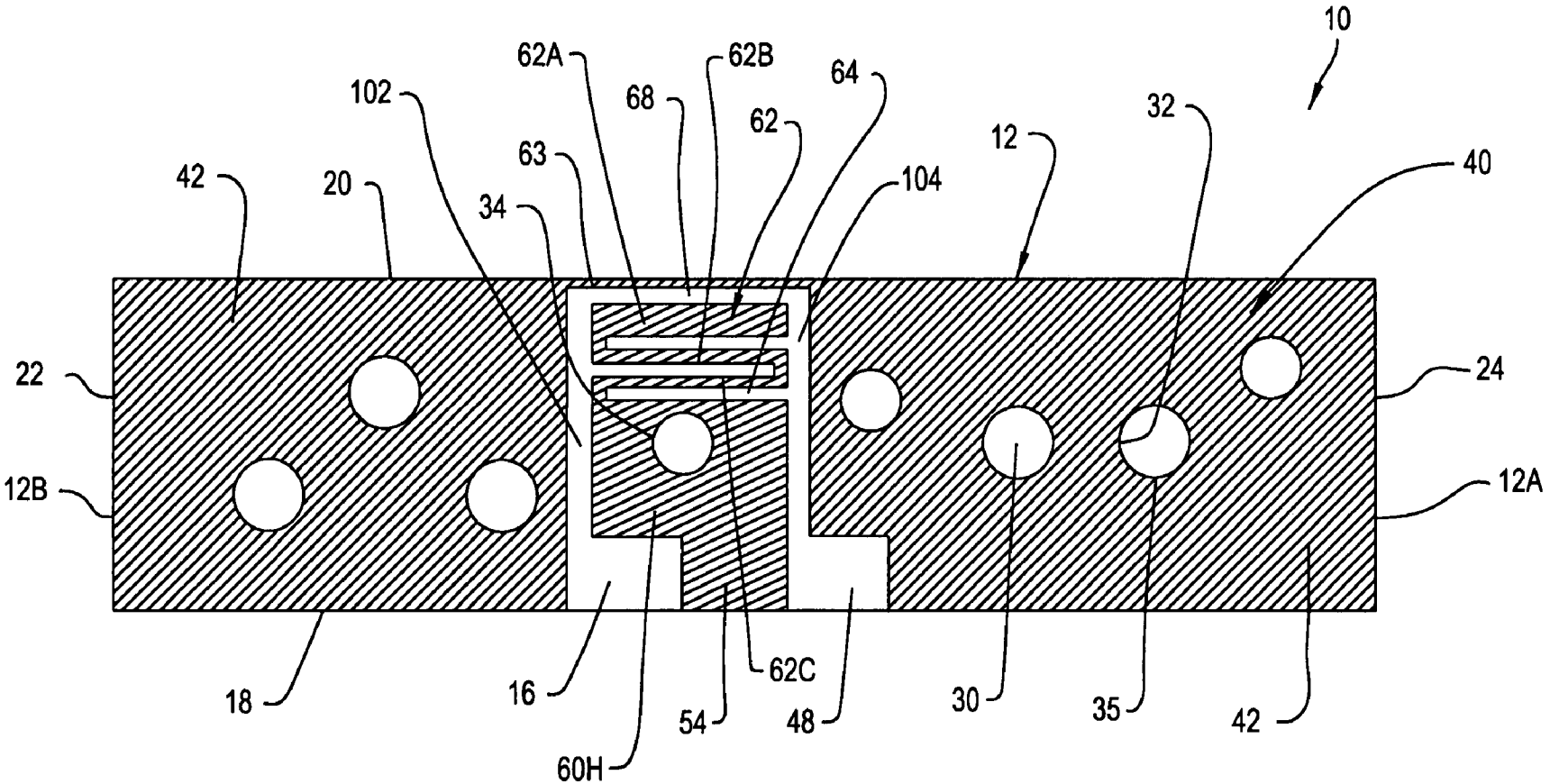
FIG. 4 is an enlarged view of the bottom surface of the duplexer of FIG. 1.
Figure 5:
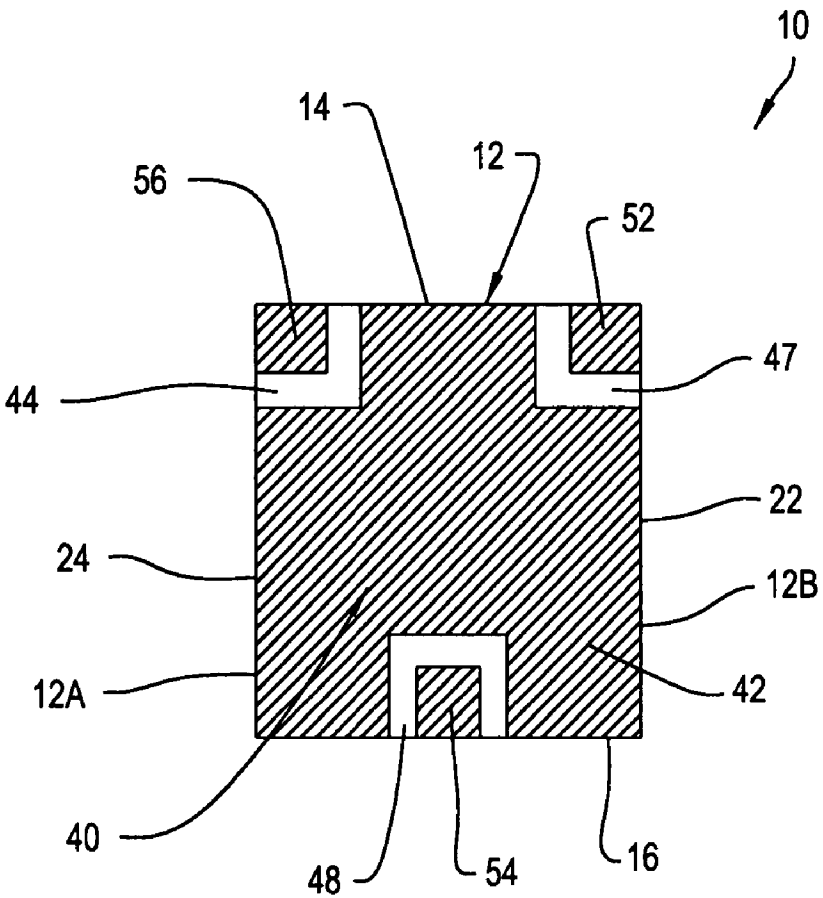
FIG. 5 is an enlarged view of the side surface of the duplexer of FIG. 1.
Figure 6:
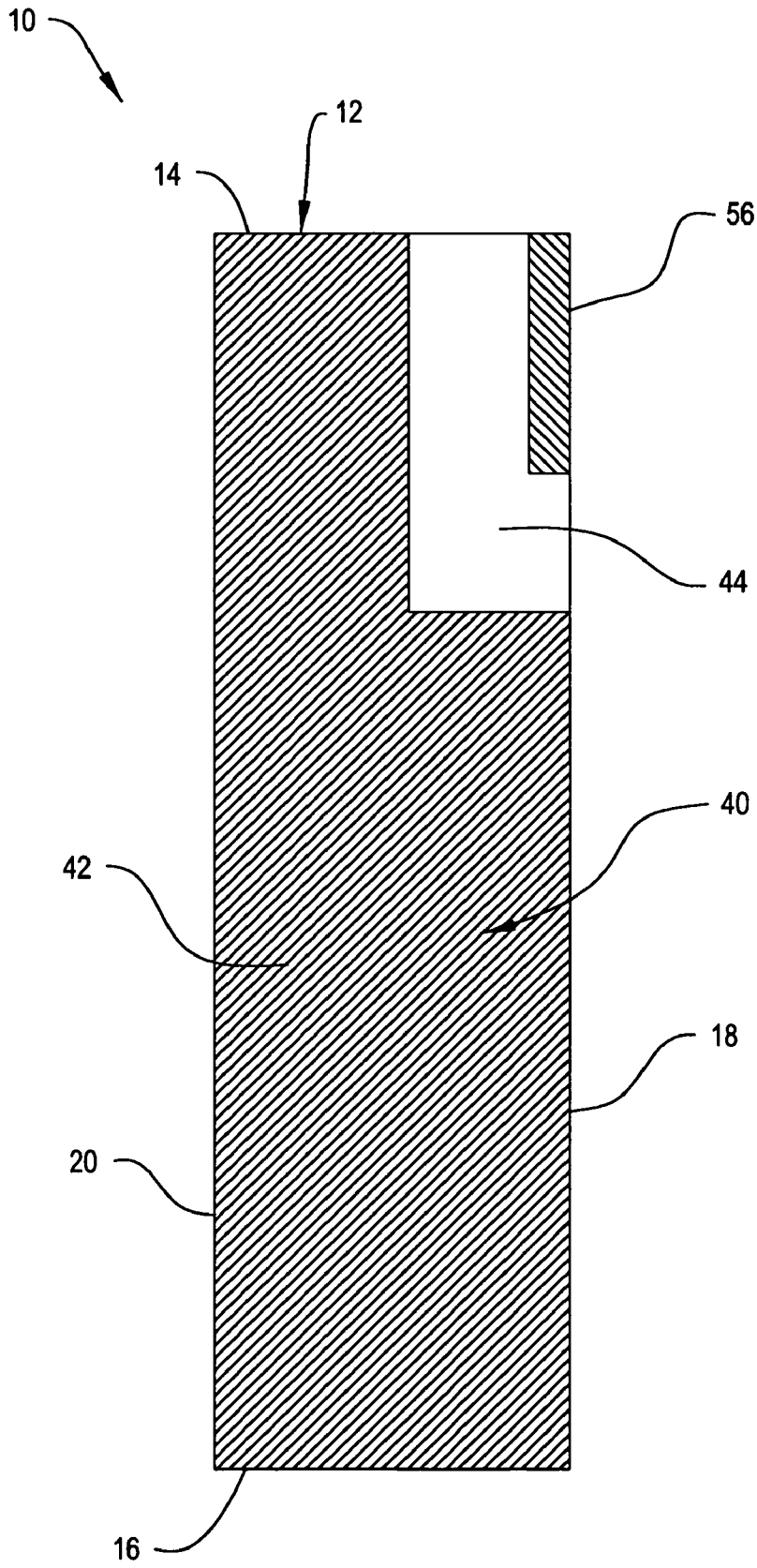
FIG. 6 is an enlarged view of another side surface of the duplexer of FIG. 1.

For ease of description, duplexer filter 10 can be divided approximately at antenna electrode 54 into two branches of resonators 25, a transmitter branch 72 (FIGS. 1,2,3) and a receiver branch 74 (FIGS. 1,2,3). Transmitter branch 72 extends between antenna electrode 54 and end 12B, while receiver branch 74 extends between antenna electrode 54 and end 12A. Each branch includes a plurality of resonators 25 and a respective input/output electrode. More specifically, transmitter branch 72 includes a transmitter electrode 52, and receiver branch 74 includes a receiver electrode 56. Transmitter electrode 52 and receiver electrode 56 are spaced apart from antenna electrode 54 in opposite directions along the length of core 12.

Filter 10 includes a signal trap resonator 81 (FIGS. 1,2,3). Receive trap resonator 81 is located in receiver branch 74 adjacent electrode 56 and end 12A.

The surface-layer pattern of metallized and unmetallized areas 40 on core 12 is prepared by providing a rigid core of dielectric material including through-holes to predetermined dimensions. The outer surfaces and through-hole side walls are coated with a metal layer, preferably including silver, by spraying, plating or dipping. The preferred method of coating the dielectric core varies according to the number of cores to be coated. After coating, the surface-layer pattern 40 is preferably created by laser ablation of the metal over areas designated to be unmetallized. This laser ablation approach results in unmetallized areas recessed into the surfaces of core 12 because laser ablation removes both the metal layer and a slight portion of the dielectric material.

Filters according to the present invention can be equipped with a metallic shield positioned across top surface 14. For a discussion of metal shield configurations, see U.S. Pat. No. 5,745,018 to Vangala, the relevant disclosure of which is incorporated herein by reference.

Dielectric block filters of this invention have several advantages. One key feature of this invention is the ability to block $3^{rd}$ harmonic frequencies. This results in less noise being present in a communication system. A second key feature is a robust design approach for manufacturing. Because the filter response can be changed by altering the pattern on the top surface, no re-tooling of the core is required.

EXAMPLE 1

A batch of duplexer filters according to the present invention and shown in FIGS. 1-6 was prepared. Specifically, the filters were prepared with a top surface pattern of metallization as shown in FIG. 3. Fabrication details are specified in Table 1, below.

TABLE 1

| | |
|---|---|
| Resonators | 8 |
| Length | 7.0 millimeters (mm) |
| Height (shieldless) | 1.7 millimeters (mm) |
| Width | 5.3 millimeters (mm) |
| Through-hole Diameter | 0.25 millimeters (mm) |
| Dielectric Constant | 37.5 |

TABLE 1-continued

| | |
|---|---|
| Average Resonator Pad Width | 1.5 millimeters (mm) |
| Average Resonator Pad Length | 2.3 millimeters (mm) |
| Intricate Extension (line width) | 0.05 millimeters (mm) |
| Intricate Extension (overall width) | 0.48 millimeters (mm) |
| Intricate Extension (overall length) | 1.16 millimeters (mm) |

The prepared duplexers were evaluated with S21 measurements on a Hewlett Packard network analyzer. The prepared example duplexers were evaluated without top shields present. Duplexer performance parameters are listed in TABLE 2, below.

TABLE 2

| | |
|---|---|
| Transmit Band | 1920-1980 Megahertz (MHz). |
| Transmit Band Insertion Loss | 1.4 dB (at about 1980 MHz) |
| Third ($3^{rd}$) Harmonic Suppression of Transmit Band | 15 dB |
| Receive Band | 2110-2170 Megahertz (MHz). |
| Receive Band Insertion Loss | 1.6 dB (at about 2110 MHz) |
| Third ($3^{rd}$) harmonic suppression of Receive Band | 18 dB |

Comparison

Figure 7:
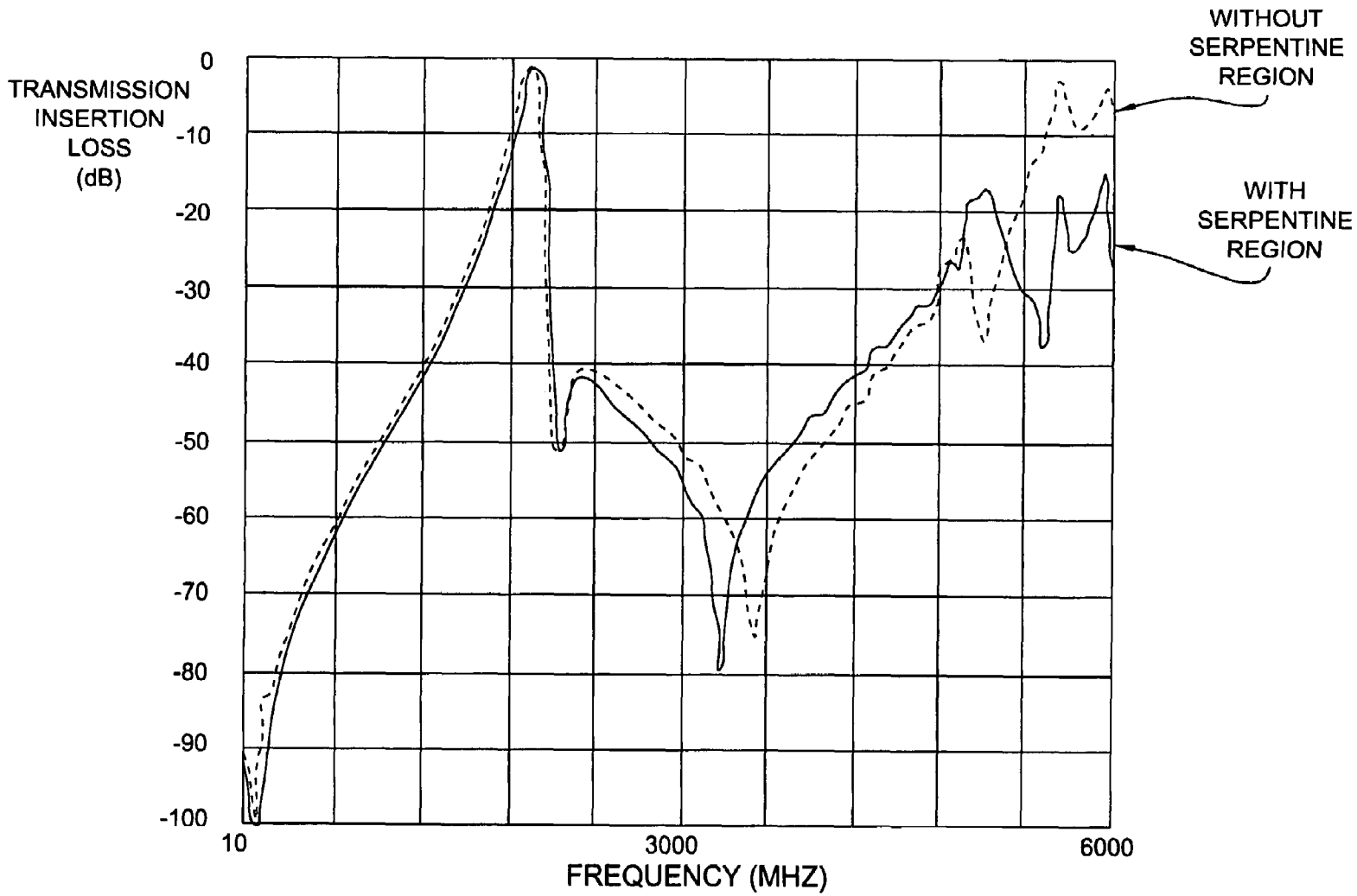
FIG. 7 is a frequency response graph for the duplexer shown in FIG. 1.

FIG. 7 is a graph of signal strength (or loss) versus frequency demonstrating the specific measured performance of the Example 1 duplexer including a serpentine region 62 and a comparison duplexer without serpentine region 62. FIG. 7 shows a graph of insertion loss (S21) for the transmission passband frequencies measured between the antenna and transmit electrode.

At a transmit frequency of 1910 MHz, a third harmonic frequency is generated at approximately 5730 MHz. The serpentine region 62 is able to increase attenuation at third harmonic frequencies by approximately 15 dB. It is also noted that the performance of the filter is not degraded in the passband or the stopband of the filter. All measurements were S21 measurements carried out on a Hewlett Packard network analyzer.

Figure 8:
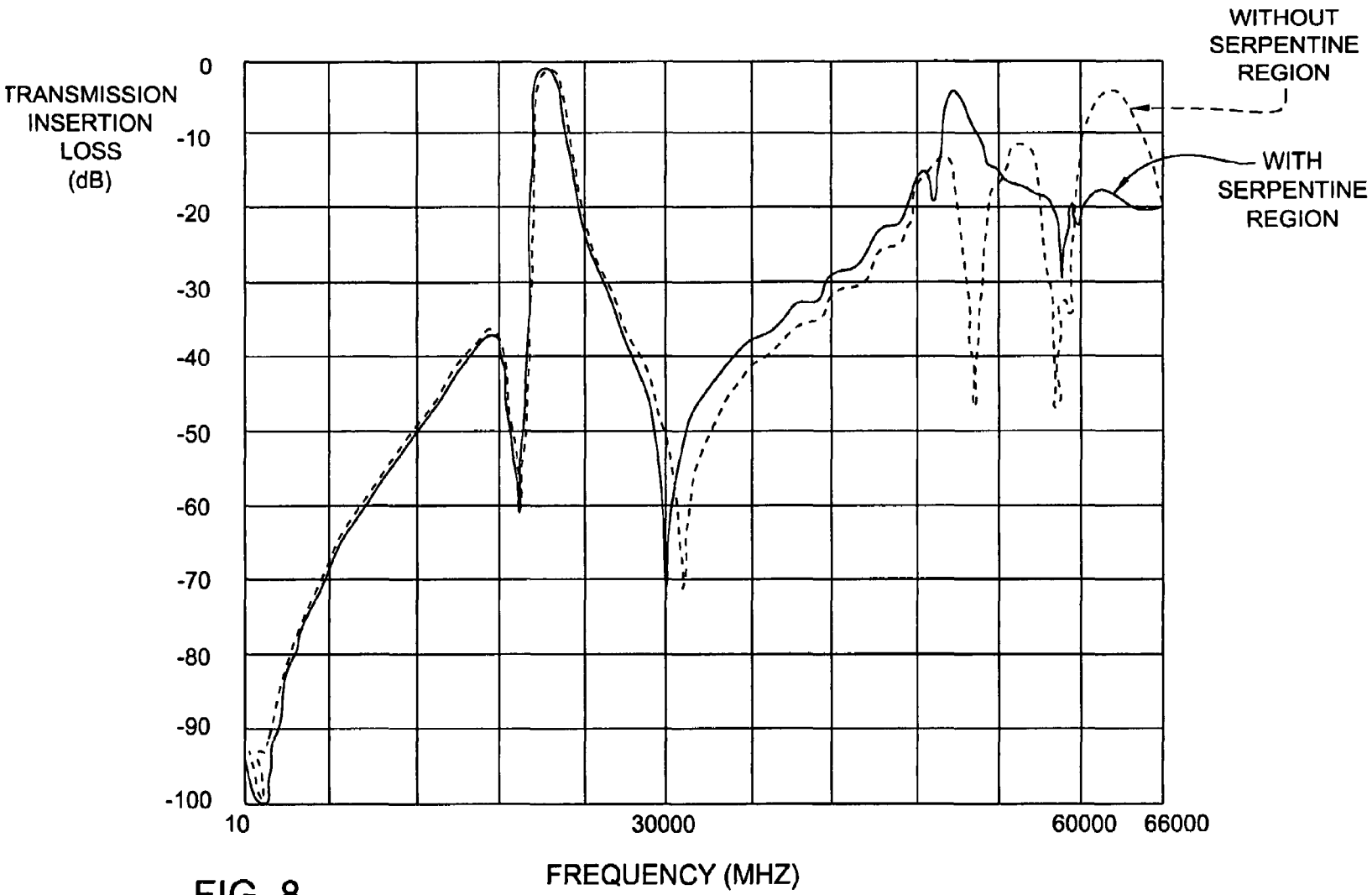
FIG. 8 is a frequency response graph for the duplexer shown in FIG. 1.

FIG. 8 is a graph of signal strength (or loss) versus frequency demonstrating the specific measured performance of the Example 1 duplexer including a serpentine region 62 and a comparison duplexer without serpentine region 62. FIG. 8 shows a graph of insertion loss (S21) for the receive passband frequencies measured between the antenna and receive electrode.

At a receive frequency of 2100 MHz, a third harmonic frequency is generated at approximately 6300 MHz. The serpentine region 62 is able to increase attenuation at third harmonic frequencies by approximately 18 dB. It is also noted that the performance of the filter is not degraded in the passband or the stopband of the filter. All measurements were S21 measurements carried out on a Hewlett Packard network analyzer.

Although the graph in FIGS. 7 and 8 showed exemplary applications in the range of 1 to 6 Giga-Hertz, an application of the present invention to frequencies in the range of 0.5 to 20 Giga-Hertz is contemplated. The present invention can be applied to an RF signal filter operating at a variety of frequencies. Suitable applications include, but are not limited to, cellular telephones, cellular telephone base stations, and subscriber units. Other possible higher frequency applications include other telecommunication devices such as satellite communications, Global Positioning Satellites (GPS), or other microwave applications.

Numerous variations and modifications of the embodiments described above may be effected without departing from the spirit and scope of the novel features of the invention. For example, the present invention can also be used with a single passband.

It is to be understood that no limitations with respect to the specific system illustrated herein are intended or should be inferred. It is, of course, intended to cover by the appended claims all such modifications as fall within the scope of the claims.

I claim:

1. A signal filter suitable for use in a mobile communication device, the filter comprising:

a core of dielectric material having a top, a bottom and four side surfaces having vertical edges;

a plurality of through-holes extending from the top to the bottom surface, each through-hole defining a resonator;

a first contiguous unmetallized area located on the top surface and extending to one of the side surfaces;

a second contiguous unmetallized area located on the bottom surface and extending to one of the side surfaces;

a first metallized area located on the bottom surface, the side surfaces and on the inner surfaces of the through-holes;

a transmitter electrode and a receiver electrode, located on the top surface and extending to one of the side surfaces;

an antenna electrode located on the bottom surface and extending to one of the side surfaces;

a first set of metallized resonator pads adjacent a portion of the through-holes on the top surface, the first set of resonator pads being connected to the first metallized area;

a second resonator pad surrounding one of the through-holes on the bottom surface, the second resonator pad extending into the antenna electrode; and a metallized serpentine region on the bottom surface, the metallized serpentine region extending into the second resonator pad.

2. The filter of claim 1 wherein the serpentine region defines a series resonant circuit to ground that attenuates the third harmonic frequency.

3. A signal filter comprising:

a rigid core of dielectric material with a top surface, a bottom surface, and at least two opposed side surfaces, said core defining at least one through-hole extending between an opening defined in the top surface and a n opening defined in the bottom surface;

a surface-layer pattern of metallized and unmetallized areas on said top surface, said bottom surface, and said side surfaces of said core, one of the said metalized areas defining a pad on one of said tip or bottom surfaces surrounding the corresponding opening of the at least one of the through-holes and extending into integral coupling relationship with another of the said metallized areas defining an antenna electrode extending onto one of the opposed side surfaces, the pad further defining a plurality of metalized strips extending in a generally serpentine relationship between the at least one through-hole opening and the other of the two opposed side surfaces.

4. A duplexing communication signal filter adapted for connection to an antenna, a transmitter and a receiver for filtering an incoming signal received at said antenna and transmitted to said receiver and for filtering an outgoing signal transmitted from said transmitter and received at said antenna, the filter comprising:

a rigid core of dielectric material with a top surface, a bottom surface and at least four side surfaces, said core defining a series of through-holes, each through-hole extending from an opening on said top surface to an opening on said bottom surface;

a surface-layer pattern of metallized and unmetallized areas on said core, the pattern including:

a wide area of metallization covering a portion of said top and bottom surfaces, said side surfaces and said through holes for providing off-band signal absorption, a first pad of metallization adjacent at least one of said through-hole openings on said top surface, a second pad of metallization surrounding one of said through-hole openings on said bottom surface, a contiguous unmetallized area substantially surrounding each of said first and second pads;

a transmitter connection area of metallization located on one of said side surfaces;

a receiver connection area of metallization on said one of said side surfaces spaced apart from said transmitter connection area, an antenna connection area of metallization positioned on said one of said side surfaces between said transmitter connection area and said receiver connection area, said antenna connection area of metallization extending into said second pad, a narrow intricate extension on said bottom surface extending from said second pad.

5. The duplexing communication filter according to claim 4 wherein said rigid core has a substantially rectangular parallelepiped shape.

6. The duplexing communication filter according to claim 4 wherein each one of said series of through-holes has side walls and said wide area of metallization is present on said bottom surface, each said side surface and said side walls of each said through-hole.

7. The duplexing communication filter according to claim 4 wherein each one of said series of through-holes has side walls and said wide area of metallization contiguously extends over said side walls of each said one of said series of through-holes, selected portions of said bottom surface, said side surfaces and selected portions of said top surface.

8. The duplexing filter according to claim 4 exhibiting a filtering passband for said incoming signal from about 2110 to about 2170 Megahertz (MHz).

9. The duplexing filter according to claim 4 exhibiting a filtering passband for said outgoing signal from about 1920 to about 1980 Megahertz (MHz).

10. The duplexing filter according to claim 4 wherein said antenna connection area extends over portions of said bottom surface and one of said side surfaces.

11. The duplexing communication filter according to claim 4 wherein at least one of said series of through-holes is positioned between a side surface of said core and said receiver connection area to serve as a signal trap resonator.

12. The duplexing filter according to claim 4 wherein said contiguous unmetallized area substantially surrounds each of said first and second pads, said antenna connection area, said receiver connection area and said transmitter connection area.

13. The duplexing filter according to claim 4 wherein said transmitter connection area extends over portions of said top surface and one of said side surfaces.

14. The duplexing filter according to claim 4 wherein said receiver connection area extends over portions of said top surface and one of said side surfaces.

* * * * *